US006394272B1

(12) United States Patent
Domansky

(10) Patent No.: US 6,394,272 B1
(45) Date of Patent: May 28, 2002

(54) CARTON AND DIVIDER PANEL

(75) Inventor: Philippe Domansky, Chateauroux (FR)

(73) Assignee: The Mead Corporation, Dayton, OH (US)

( * ) Notice: Subject to any disclaimer, the term of this patent is extended or adjusted under 35 U.S.C. 154(b) by 1053 days.

(21) Appl. No.: 08/617,829

(22) PCT Filed: Jul. 7, 1995

(86) PCT No.: PCT/US95/09408

§ 371 (c)(1),
(2), (4) Date: Jun. 6, 1996

(87) PCT Pub. No.: WO96/01769

PCT Pub. Date: Jan. 25, 1996

(30) Foreign Application Priority Data

Jul. 8, 1994 (GB) ..... 9413865

(51) Int. Cl.[7] ..... B69D 69/00
(52) U.S. Cl. ..... 206/434; 206/151; 206/161
(58) Field of Search ..... 206/427, 430, 206/150, 151, 145, 158, 161, 434, 140, 433, 429, 193, 194

(56) References Cited

U.S. PATENT DOCUMENTS

| | | | | | |
|---|---|---|---|---|---|
| 2,849,111 | A | * | 8/1958 | Fielding | 206/434 |
| 3,128,010 | A | * | 4/1964 | Forrer | 206/140 |
| RE25,949 | E | * | 12/1965 | Andre | 206/140 |
| 3,351,264 | A | | 11/1967 | Bostrom | 229/120.32 |
| 3,429,496 | A | * | 2/1969 | Hickin | 206/140 |
| 3,679,121 | A | * | 7/1972 | Morgese | 206/140 |
| 4,328,893 | A | * | 5/1982 | Oliff et al. | 206/140 |
| 4,739,884 | A | | 4/1988 | Duplessy | 206/499 |
| 4,756,419 | A | * | 7/1988 | Le Bras | 206/140 |
| 4,911,300 | A | * | 3/1990 | Colonna | 206/433 |
| 4,932,531 | A | * | 6/1990 | Bakx | 206/434 |
| 5,031,770 | A | * | 7/1991 | Chaussadas | 206/140 |
| 5,186,321 | A | * | 2/1993 | Fadus | 206/151 |
| 5,246,113 | A | | 9/1993 | Schuster | 206/430 |
| 5,311,984 | A | * | 5/1994 | Harris | 206/140 |
| 5,320,216 | A | * | 6/1994 | Pangborn | 206/158 |
| 5,427,242 | A | | 6/1995 | Oliff | 206/430 |
| 5,441,147 | A | * | 8/1995 | Tanner | 206/150 |
| 5,526,925 | A | * | 6/1996 | Bernstein | 206/158 |
| 5,542,536 | A | * | 8/1996 | Sutherland | 206/434 |

FOREIGN PATENT DOCUMENTS

| | | | | |
|---|---|---|---|---|
| EP | 0 595 602 A1 | | 5/1994 | |
| GB | 2 247 449 A | | 3/1992 | |
| WO | WO 85/02385 | * | 6/1985 | 206/434 |

* cited by examiner

*Primary Examiner*—Shian Luong
(74) *Attorney, Agent, or Firm*—Michael V. Drew

(57) ABSTRACT

A divider panel (60) for separating two or more tiers of stacked articles (A) in a packaged carton (100) has deformable means (62, 62*b*, 62*c*, 62*d*) adapted operably to nest between stacks articles (A) on adjacent sides of the panel (60).

10 Claims, 13 Drawing Sheets

CARTON AND DIVIDER PANEL

The invention relates to cartons for packaging a plurality of articles such as cans or bottles for example. More particularly it relates to cartons and divider panels used for packaging two or more layers, or tiers, of articles.

It is known from U.S. Pat. No. 5,246,113 (Schuster) to provide a carton for a double layer of articles wherein superposed articles are stacked end to end. Schuster also discloses the use of a dividing panel between the ends of the stacked articles. Two types of divider panels are disclosed which both comprise a substantially planar, rectangular piece of paperboard. In one embodiment the panel comprises deformable portions which cup the ends of the stacked articles, and in both embodiments the panels comprise an end tab used to position the panel adjacent a first layer of articles prior to pushing an upper layer of articles over the divider panel into position above the lower layer of articles.

The invention seeks to avoid or at least mitigate various problems of the prior art. According to one aspect of the invention, there is provided a divider panel for separating stacked articles in a packaged carton having two or more tiers of articles where the panel comprises deformable means which is adapted operably to nest between stacked articles on adjacent sides of the panel.

Preferably the deformable means comprises a region of the divider panel surrounding an aperture having diameter less than the diameter of a rim at the end of an article with which the deformable portion operably nests.

The deformable means can be deformable by means of pressure applied by nested articles or emulation means to effect deformation prior to packaging in a carton such as a wraparound carton. The deformable means can be defined by an outer fold line, which can comprise a series of cuts. The series of cuts can form a circle, or can be substantially parallel to an inner edge of the deformable means. The outer cut can be discontinuous thereby to create one or more hinges. One or more ends of one or more of said cuts can be turned inwardly. The deformable portion can comprise an annular region defined by inner and outer cuts. The annular region can be continuous.

The deformable means can comprise a series of tabs, which can be defined in part by radial cuts.

The divider panel can comprise means to enable the panel to be conveyed in a fixed relative position with respect to an end of a first article in a tier of articles.

Indeed another aspect of the invention provides a divider panel for separating stacked articles in a carton having two or more tiers of articles wherein the panel comprises means to enable the panel to be conveyed in a fixed relative position with respect to a first tier of articles.

The conveying means can comprise means for cooperating with an external conveyor, which cooperating means can comprise a recess or aperture in the panel.

The panel can comprise means for cooperating with articles in the first tier thereby to help maintain their relative positions. The means can also comprise locking tabs which operably abut or engage parts of the articles in the first tier. The locking tabs can be hingably connected to the divider panel and are operably folded away from the divider panel thereby to engage the first tier of articles.

The divider panel can further comprise means at the ends of the panel to enable a continuous series of panels to be processed due to cooperation by said end means with means for effecting folding of said locking tab for example.

The end means can comprise a recess at one end of the divider panel.

A further aspect of the invention provides a carton comprising two or more tiers of stacked articles wherein each tier is separated from an adjacent tier by a divider panel according to other aspects of the invention.

A yet further aspect of the invention provides a blank for forming a carton according to another aspect of the invention.

Embodiments of the invention will now be described, by way of example only, with reference to the accompanying drawings in wich:

Figure 1:
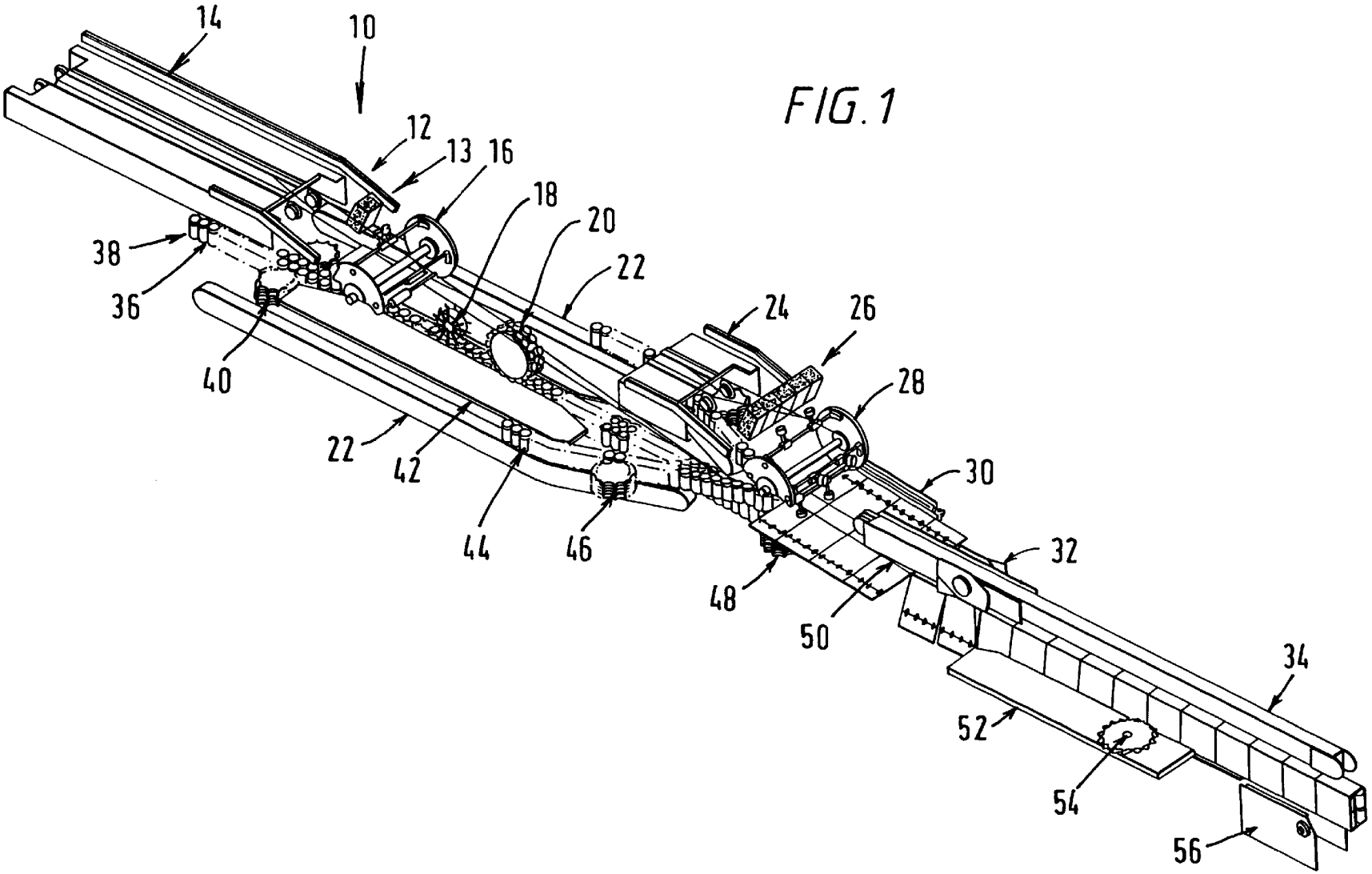
FIG. 1 is a schematic perspective view of machinery used to package a carton according to the invention.

Referring to FIG. 1 there is shown a packaging machine 10 for packaging a carton according to the invention. In general terms, the machine takes an incoming feed of articles such as cans of drinks and divides these into upper and lower feed paths. A divider panel is added to arrays of articles in the lower feed path and then the panel is manipulated to ensure that deformable portions of the divider panel are properly nested with the tops of articles. The upper layer of articles is then stacked on top of the divider panel in register with a lower article such that the bottom of an upper article nests in the deformable portion of the divider panel which is nested in the upper part of the lower article. The stacked, divided, double layer of articles are then packaged in a carton, which in this example is of the wraparound type.

The fact that the upper and lower articles are nested, described more fully later on with reference to FIGS. 2 to 5, means that the stacked articles will not settle significantly in the packaged carton during storage or transportation. Accordingly the articles should be retained in a tight fit within a wraparound carton. Of course, the divider panel 60 also ensures that the tops and bottoms of adjacent articles do not rub against one another in a packaged carton which would otherwise create unsightly marking of the ends of at least one of the articles. For example, where the articles A are made of aluminum, constant rubbing of adjacent ends of stacked articles can lead to an unsightly deposit containing aluminum oxide, on one of the ends. Additionally, movement of the articles can lead to damage to the ends of the articles, including to ring pulls at the end of a can.

Referring more specifically to the components of machine 10 as shown in FIG. 1, it can be seen that two lower rows of articles 38 are fed along a conveyor 36 into the machine. The flow of articles A in rows 38 is regulated by a pair of so-called star wheels 40. A feeder mechanism 16 draws divider panels, or inserts, 60 from a stack 13 thereof in a hopper 12, which in this example comprises an extension feature 14 for holding a large number of inserts. The feeder mechanism 16 can comprise vacuum cups for example which pick up the front divider panel 13 from the hopper and transport it to a position adjacent the tops of articles A in lower rows 38.

Figure 2:
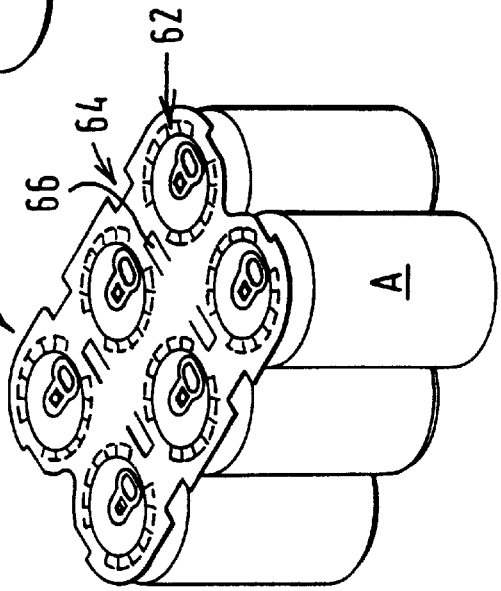

As can be seen in FIG. 2, the divider panels 60 comprise lateral recesses 64 which enable the panel to be carried by lug chains 42 provided adjacent the tops of articles A on each side of the rows 38. Thus, by synchronising the movement of lug chains 42 with the regulated flow of rows 38 and feeder 16, an array of articles and a divider panel 60 can be brought together with the deformable portion 62 of panel 60 being in register with the tops of articles A in the array.

The arrays of articles and divider panels are then conveyed along the lower feed path to an insert clipping wheel 18 which causes locking tabs 66 defined in insert 60 to be forced out of the plane of the divider panel such that they wedge between the tops of adjacent articles in the lower array. In this example, the articles A are cans which have an upper rim R which is of lesser diameter than the main body diameter of the substantially cylindrical cans. The locking tabs 66 can therefore be positioned in the gap between rims of adjacent articles thereby to hold the divider panel 60 in place during movement of the lower array of articles.

Figure 6:
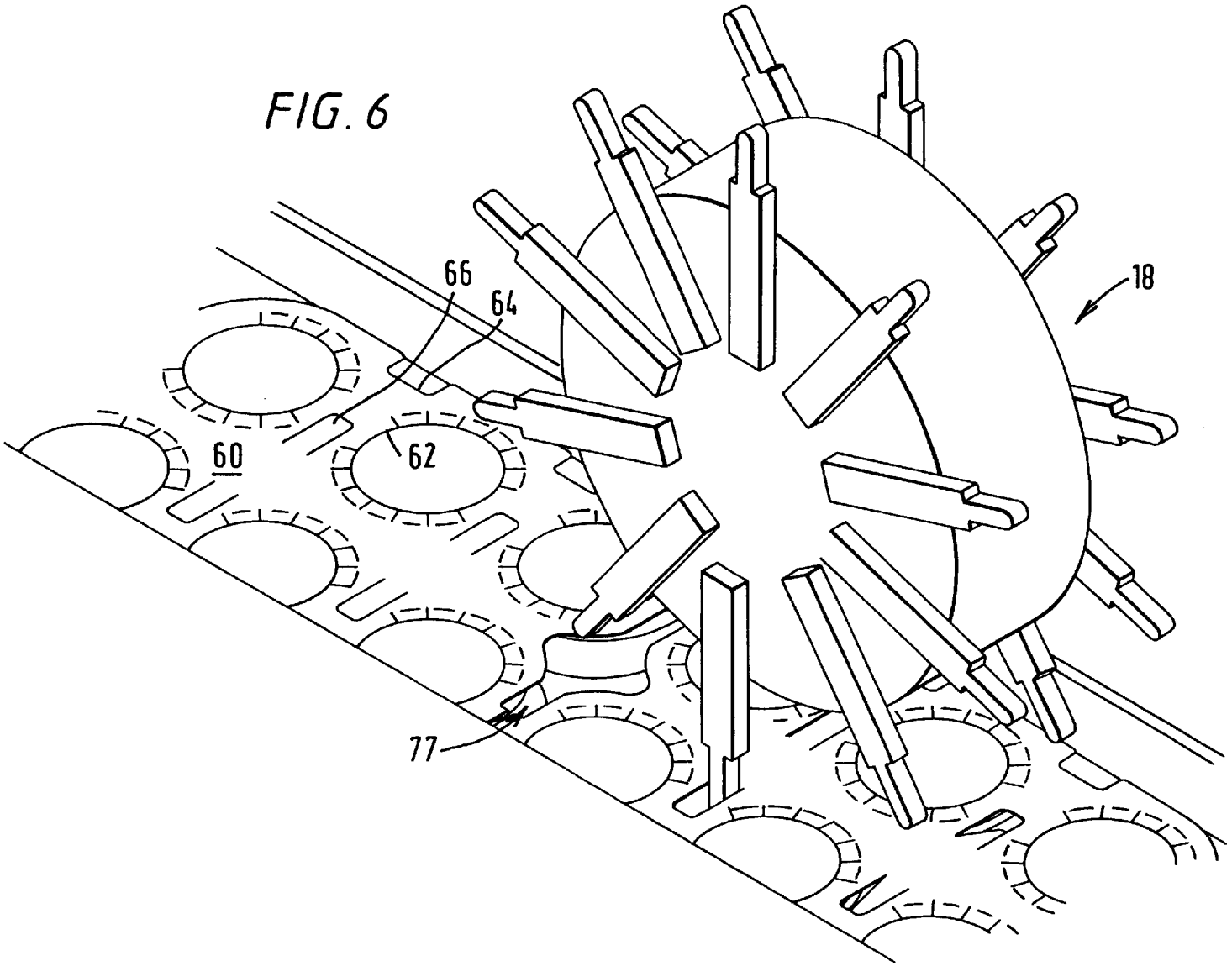
FIG. 6 is a schematic perspective view of the first embodiment of a divider panel according to the invention at an article interlocking stage of the packaging process shown in FIG. 1.

Insert clipping device 18 is shown in greater detail in FIG. 6 which shows that the device comprises a cylindrical wheel which is driven by means not shown to cause radially extending figures to rotate about the central axis of the wheel. The shaped end portion of a finger abuts the upper surface of a locking tab 66 of divider panel 60 as the fingers rotate to a lowermost position. Advantageously, the end portions can be rounded to enable easy entry and exit of the fingers from the apertures surrounding tab 66 in the panels 60.

Figure 5:
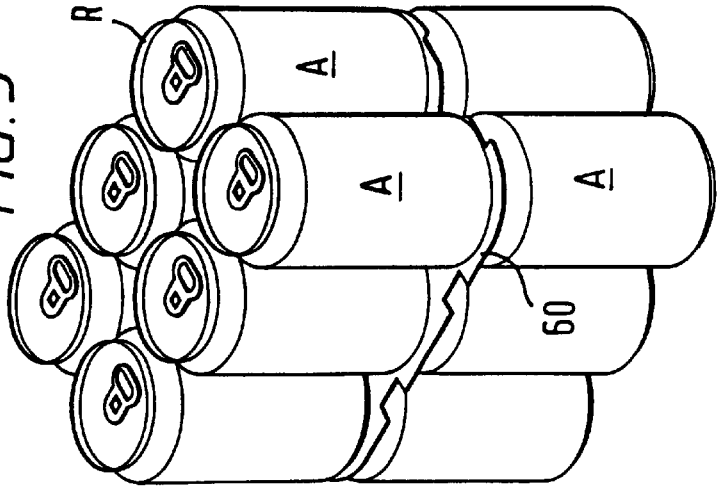
FIGS 2 to 5 are schematic perspective views of an array of articles and a divider panel according to the invention at various ages in the packaging process.
Figure 4:
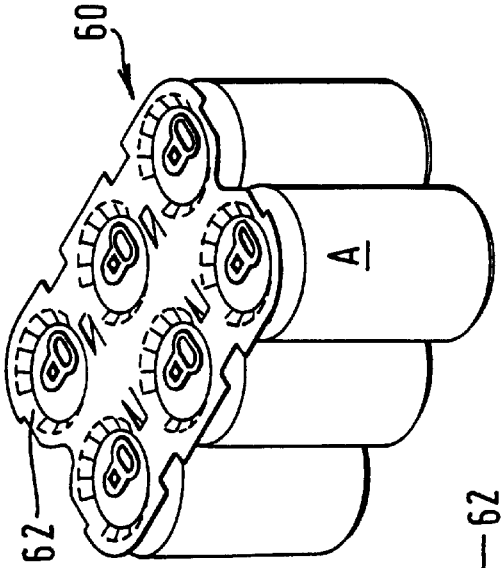
Figure 3:
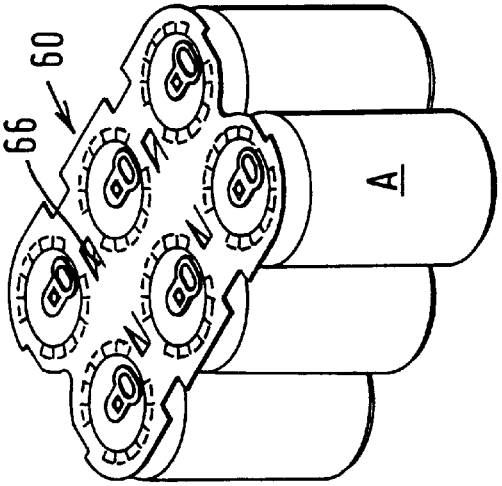
Figure 7:
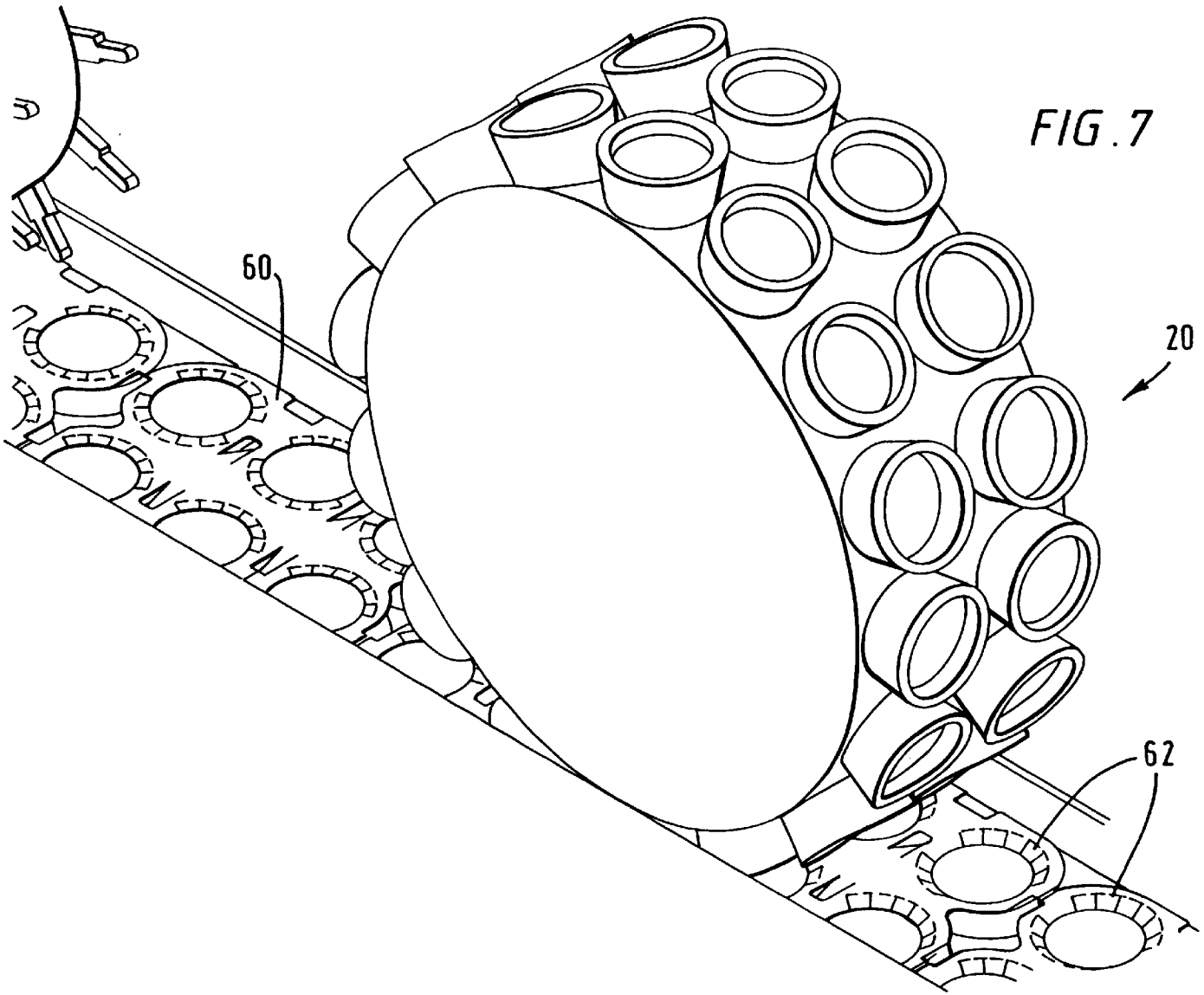
FIG. 7 is a schematic perspective view of the first embodiment a divider panel according to the invention at a punch wheel stage of the packaging process.

An array of articles as shown in FIG. 3 is then conveyed to a punch wheel 20 which is shown in greater detail in FIG. 7. The punch wheel comprises a cylindrical wheel which is driven about its cylindrical axis by a means not shown. The cylindrical surface of the wheel comprises two rows of hollow cylindrical cups which have a rim which simulates the base of an article. The movement of punch wheel 20 is again synchronised with the movement of the lower arrays of articles and insert panels such that individual cups cause the deformable portion 62 in panels 60 to deform and thus nest in the tops of the articles A. As can be seen in FIG. 5 for example, the articles comprise an upper end which is longitudinally recessed with respect to upper rim R. Thus, the deformable portion 62 provides a cup-like structure between the rim R and the end of an article. This arrangement is shown in FIG. 4. Thus, the divider panel 60 can be held in place on a lower array of articles due to the effects of one or both of the tabs 66 and the deformable portion 62. Additionally, lug chains 42 can still engage recesses 64 thereby ensuring that individual divider panels 60 are accurately positioned with respect to an array of articles.

An upper array of articles is now created ready to be stacked on top of an array such as shown in FIG. 4. In this example, two upper rows 44 of articles are conveyed along conveyors 22. The rows can be guided by fixed rails not shown in the attached drawings. The flow of a row of articles 44 can be regulated by a star wheel 46 and then the movement of both the upper and lower arrays of articles can be regulated by a device 48 such as a vertically extended star wheel. In this example regulator 48 which effects the stacking of an upper and lower pair of articles comprises a side-by-side pair of star wheels (not shown).

Aligned recesses in upper and lower sets of plates in each star wheel effect an alignment of an upper and lower article such that as an upper article moves away from its support platform and as a star wheel rotates it provides an effective chute through which an upper article falls under gravity into the cup defined by deformable portion 62 in the top of the lower article. By repeating this process, a stacked array as shown in FIG. 5 is created. Of course, the number of articles in a stacked group can be anything from a stacked pair, three or four stacked articles and so on. The arrays can of course comprise any number of rows.

The stacked array can be conveyed as a unit, for example, using a conventional conveyor beneath the lower array of articles, to a carton loading station.

Figure 14:
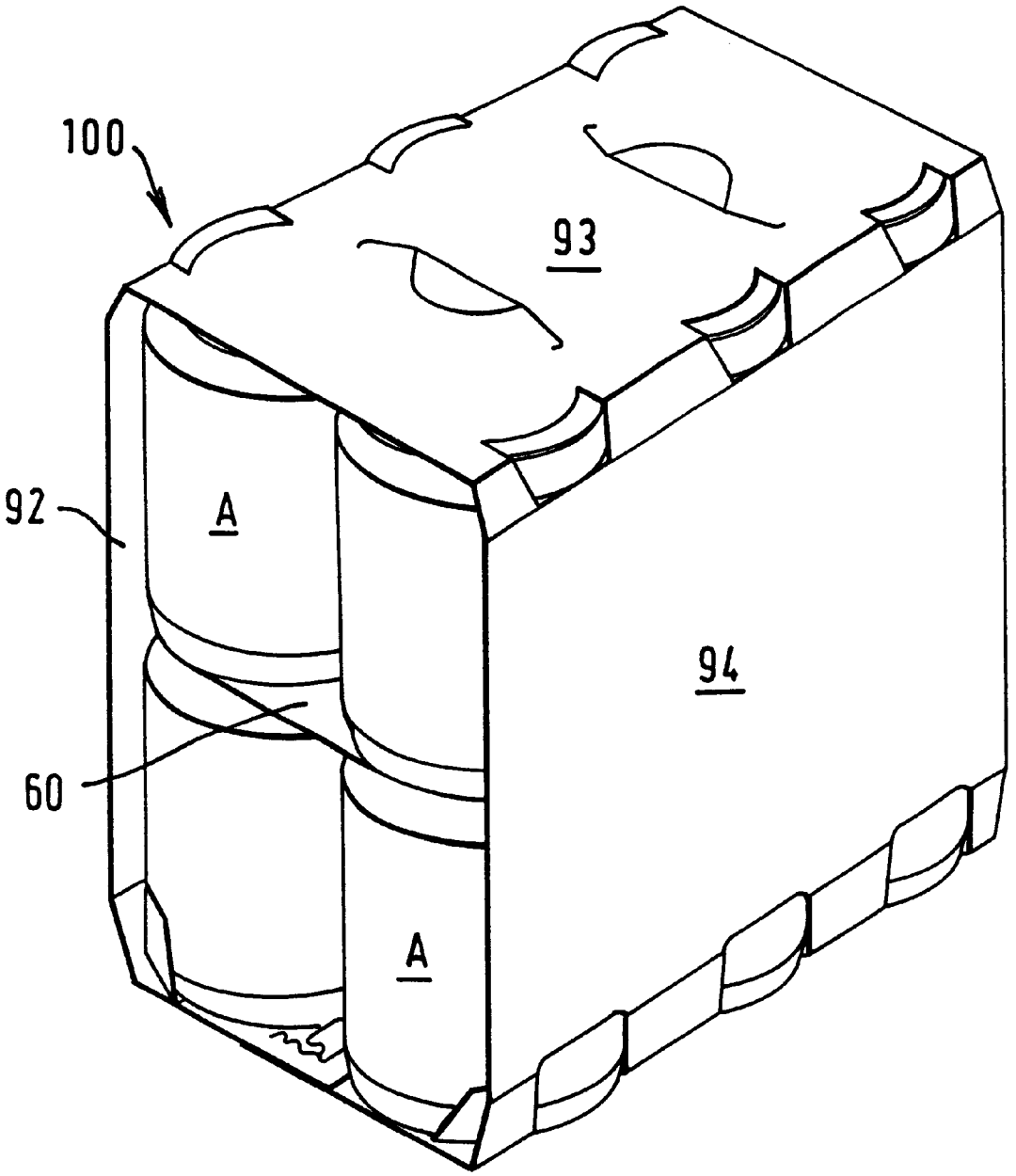
FIG. 14 is a perspective view of a carton formed from the blank shown in FIG. 13.
Figure 16:
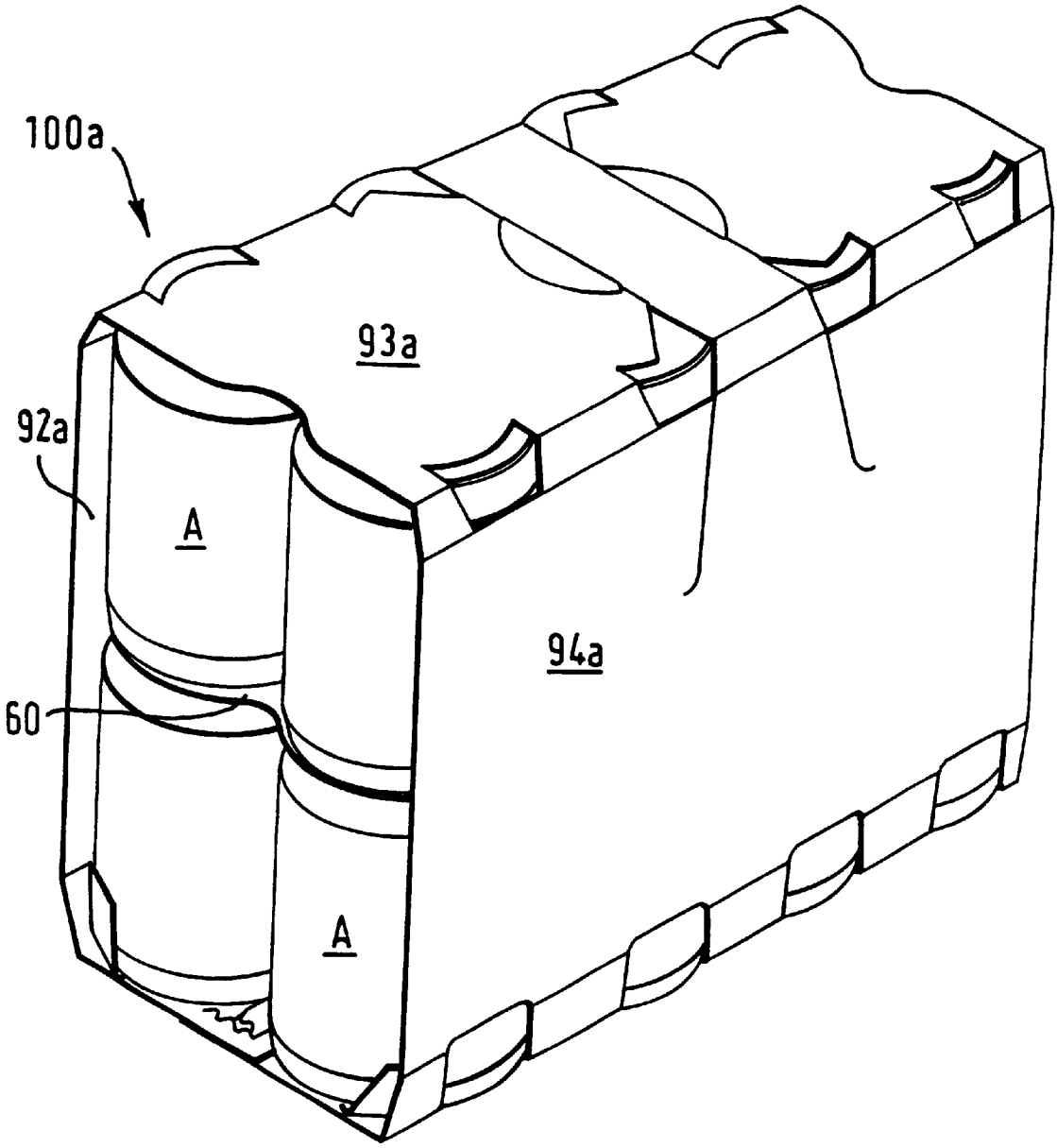
FIG. 16 is a perspective view of a carton formed from the blank shown in FIG. 15.

In this example, the stacked array of articles are loaded into a wraparound carton to provide a package carton 100 or 100*a* as shown in FIG. 14 or 16 respectively. Referring to FIG. 1, machine 10 comprises a hopper 24 for a stack 26 of carton blanks (90 or 90*a*). An individual carton blank can be withdrawn from the front of the stack 26 using a feeder mechanism 28 similar to mechanism 16 described earlier. A carton blank can thus be moved from hopper 24 to a feed chain 30 which can comprise lugs for example which engage cooperating parts of the carton to enable it to be conveyed to an overhead boom chain 34. At front section 50 of the boom chain 34 a device initially presses the top panel 93, 93*a* of the carton against the upper ends of the upper articles. The sides 92 and 94 of the carton 100, 100*a* are then folded downwardly using folding wheel 32. The sides of the cartons are then guided by a carton side lug chain 52 along to an article heel expander device 54 which causes known article heel engaging devices 97, 97*a* where these are provided by the carton, to be expanded prior to pressing the sides of the carton 92 and 94 against the sides of the array of stacked articles. Boom chain 34 can continue to press the top of the carton against the array of articles whilst a locking mechanism 56 effects the folding of base panel portion 91 and 95 to the underside of the stacked array of articles.

Figure 8:
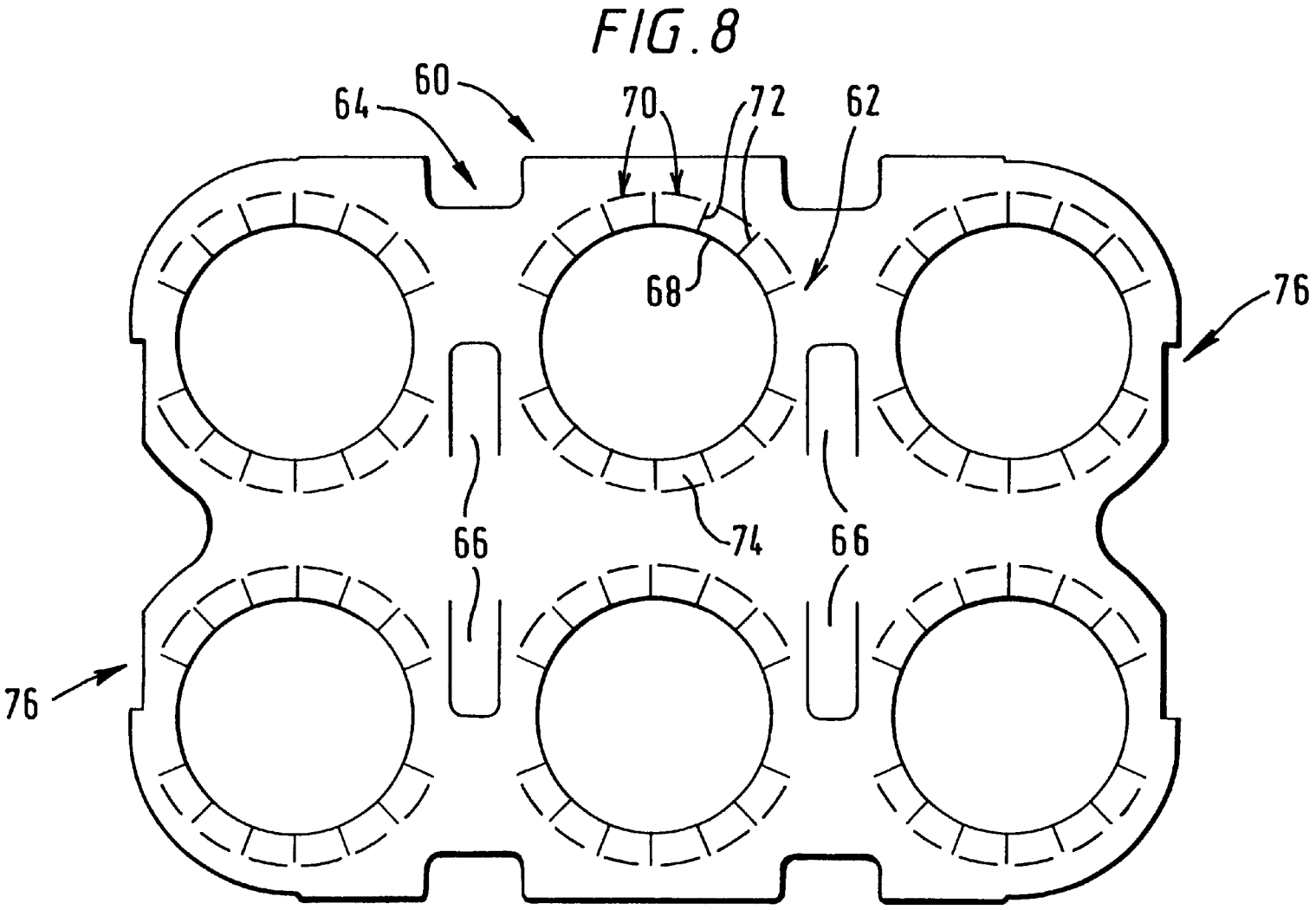
FIG. 8 is a plan view of the divider panel according to the first embodiment of the invention.

FIG. 8 shows a plan view of one form of divider 60 according to the invention. As described earlier, the divider panel comprises an array of deformable portions 62, side recess portions 64 and locking tabs 66. Additionally, divider panel 60 comprises end recesses 76 which, as can be seen from FIG. 6, can be used to enable a series of divider panels to be continuously processed through clipping wheel 18 since an aperture 77 is created by adjacent recesses 76 which can accommodate the ends of the fingers of the clipping device.

The deformable portion 62 in this example, comprises a series of foldable tabs 74. Each tab is defined by an inner circular cut 68 and a pair of radial cuts 72. An effective fold line is created in this example by providing a series of cuts 70 which thereby provide hinges in the divider panel 60 which can for example be made of paperboard.

Figure 9:
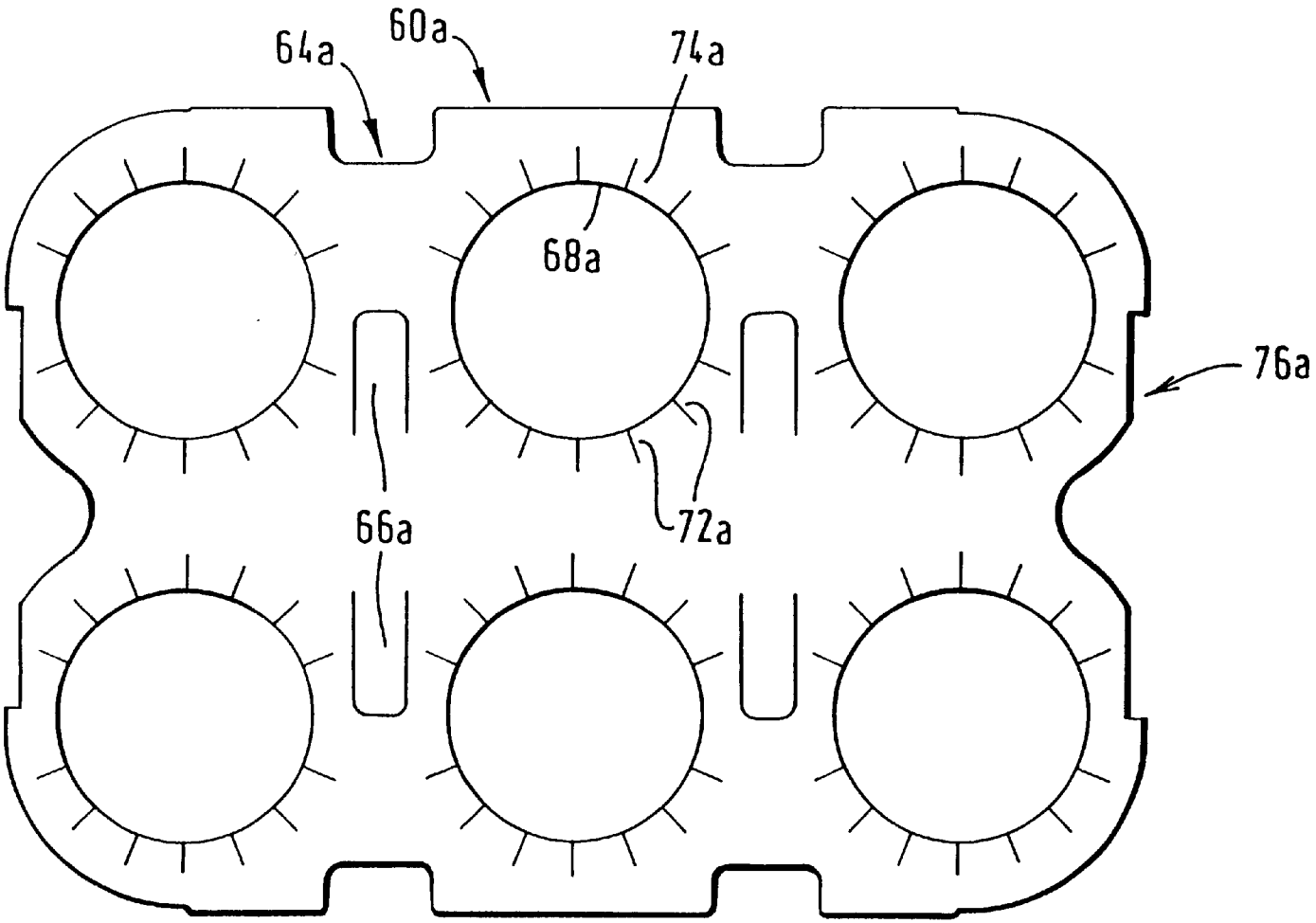
FIG. 9 is a plan view of a second divider panel according to the invention.

In FIG. 9 a further embodiment of a divider panel 60*a* is shown in plan view. This panel is substantially similar to panel 60 where like integers are given the same reference numerals suffixed with the letter a. In this case, a fold line for tabs 74*a* is not specifically defined and the deformed cupping feature can be created using a device similar to the punch wheel described earlier.

Figure 10:
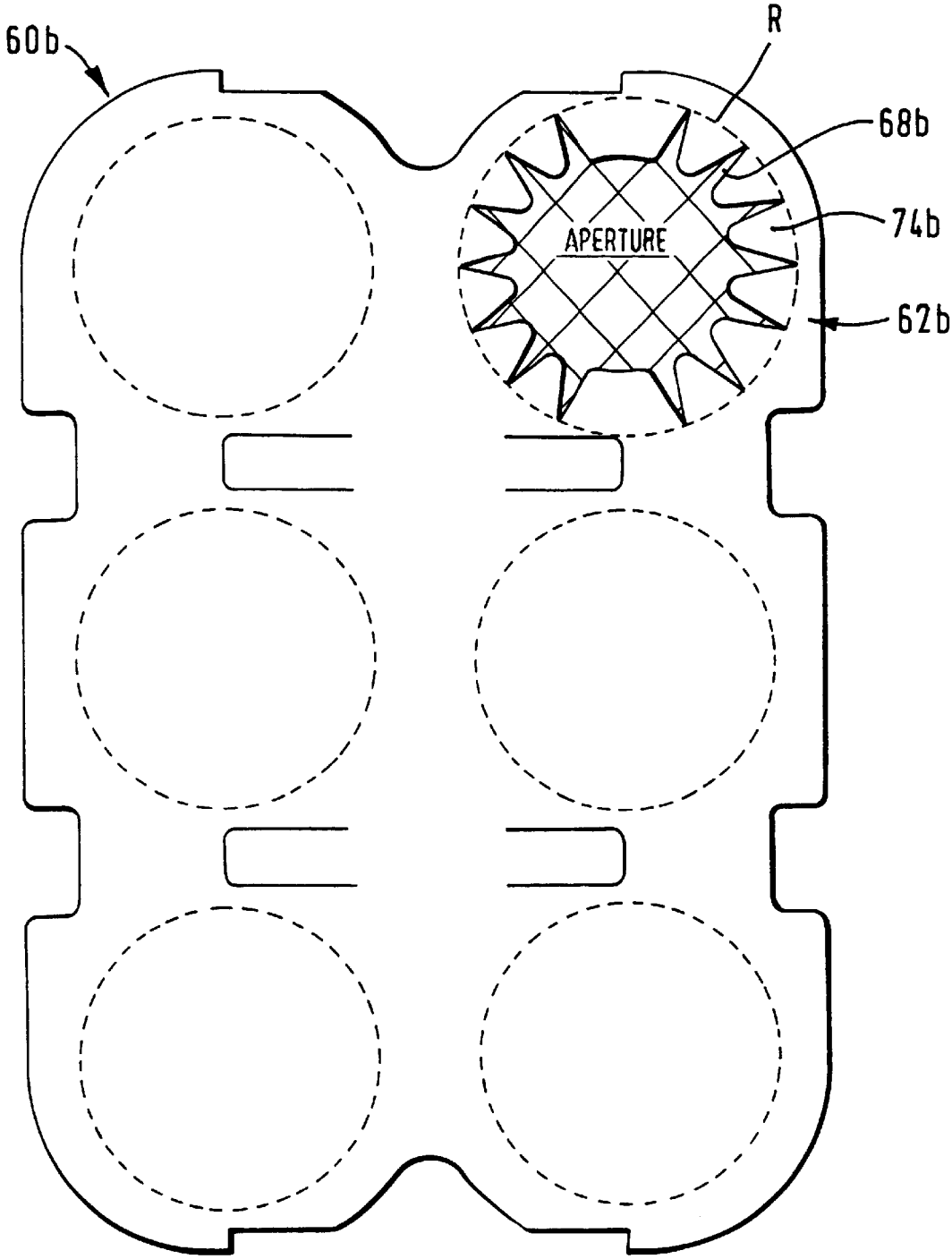
FIG. 10 is a plan view of a third embodiment of a divider panel according to the invention.

FIG. 10 shows a further embodiment of a divider panel 60*b* according to the invention. Again, features common to divider panels 60 are labelled using the same reference numerals suffixed with the letter b. In this example, the deformable portions 62*b* comprise rounded tabs 74*b* wherein a serrated inner edge is defined by a wavy cut line 68*b*. The tabs need not have a pre-defined fold line where for example a punch wheel as described earlier is used to create the cupping feature. However, it is preferable that the tab 74*b* extends substantially within the outer diameter of rim R of an article as shown schematically in FIG. 10 by the dotted line. Thus, the tabs 74*b* will be able to provide a barrier between the ends of stacked articles.

Figure 11:
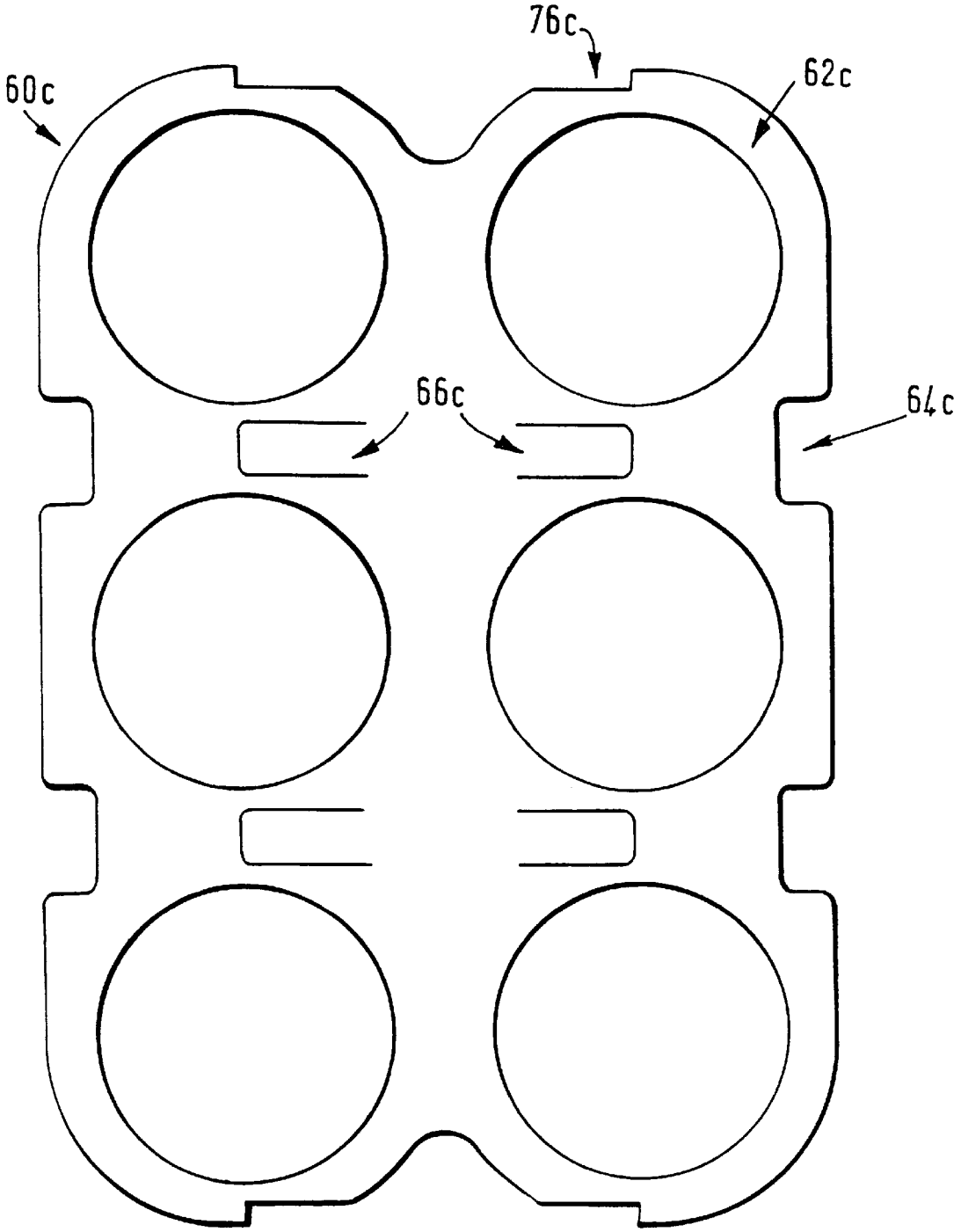
FIG. 11 is a plan view of a fourth embodiment of a divider panel according to the invention.

FIG. 11 shows a further embodiment of a divider panel 60*c* according to the invention. Again, the divider panel preferably comprises lateral recesses 64*c* and end recesses 76*c*. In this example however, deformable tabs are not defined within a deformable portion 62*c* which instead is simply defined by a circular cut in the panel. The diameter of the aperture that is created should be less than the diameter of the rim R of an article such that a cupping feature can be created using a device such as the punch wheel to deform the paperboard into the cup-like nesting feature. Of course this feature can also be created by applying a load on stacked articles themselves, which preferably takes place prior to closing a wraparound carton where such a carton is used. Preferably, article locking tabs 66*d* are provided.

Figure 12:
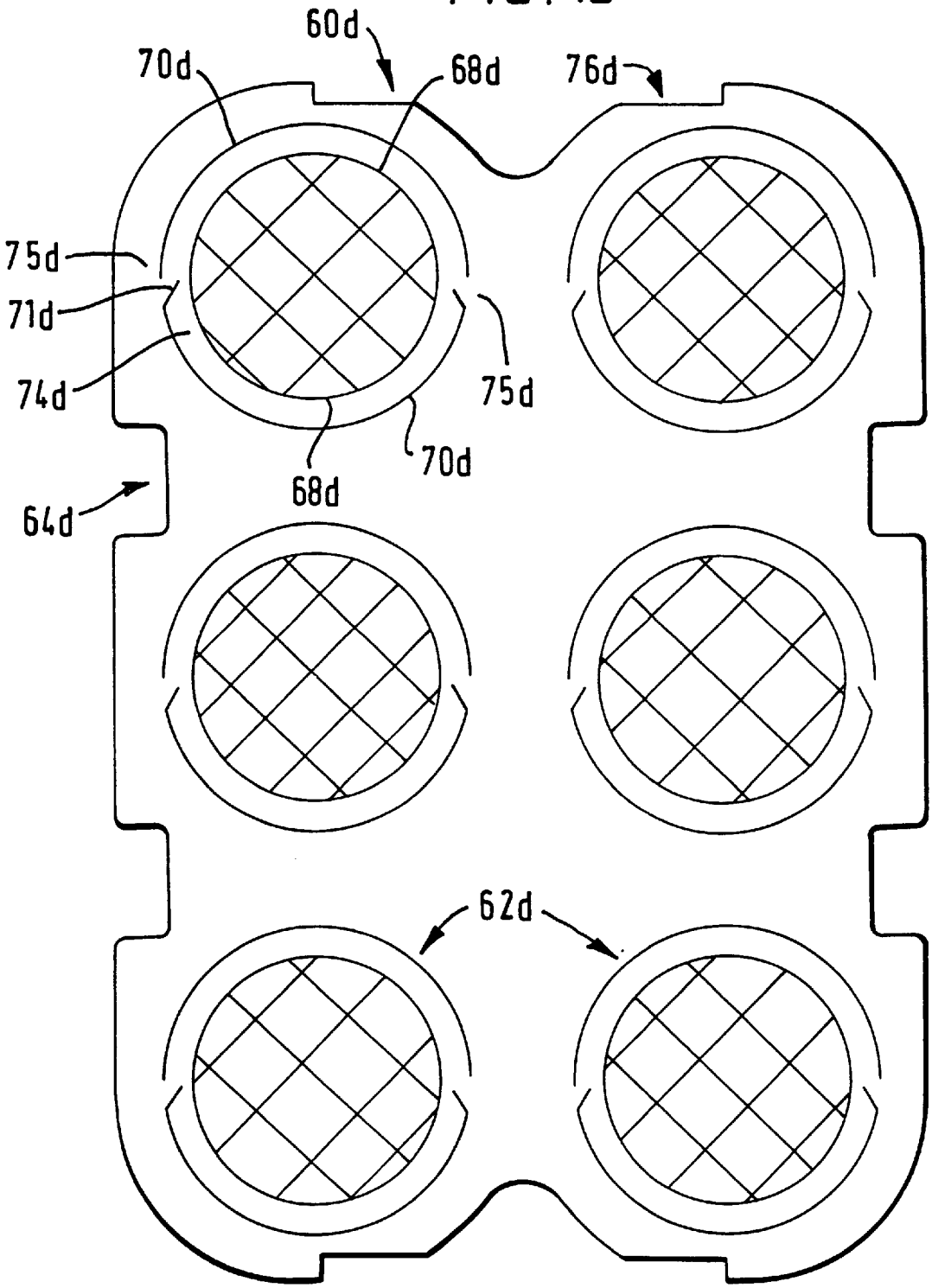
FIG. 12 is a plan view of a fifth embodiment of a divider panel according to the invention.

In FIG. 12 a yet further embodiment of a divider panel 60*d* according to the invention is shown. In this example, end and side recesses 76*d* and 64*d* respectively can be provided. Additionally, locking features 66*d* could be provided but are not shown. The deformable portion 62*d* comprises a movable tab 74*d* which is defined by a continuous inner circular cut 68*d* and a discontinuous outer, substantially circular cut 70*d*. The outer cut 70*d* comprises inwardly extending end portions 71*d* which can be used to help enable greater deformity of a deformable portion 62*d* in use and possibly prevent tearing. The tab 74*d* is hingably connected to the rest of the panel by hinges 75*d* created by discontinuous outer cut 70*d*.

Figure 13:
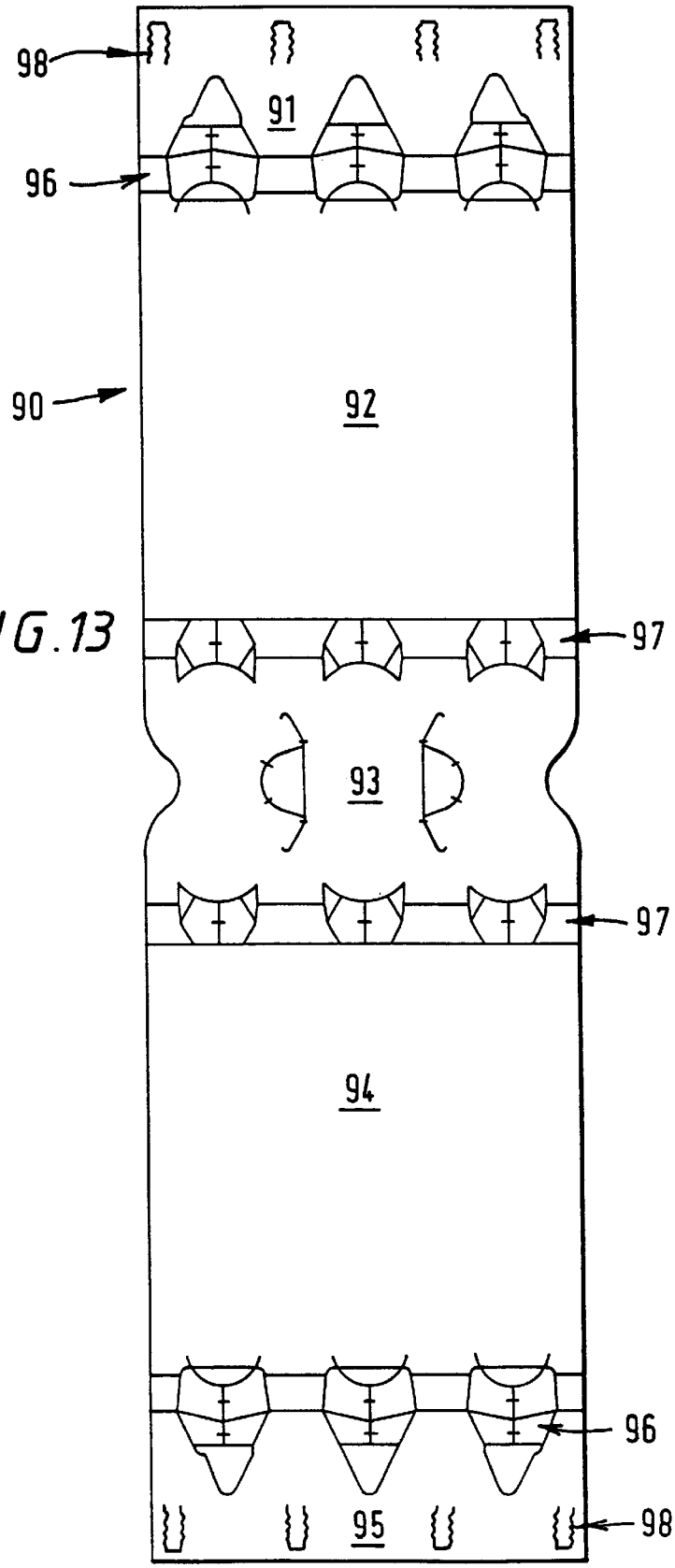
FIG. 13 is a plan view of a carton blank for a carton according to the invention.

FIG. 13 shows a plan view of a carton blank 90 for a carton according to the invention. Carton blank 90 comprises a first base panel portion 91, a side panel 92, a top panel 93, a second side panel 94, and a second base panel portion 95. These panels are hingably interconnected in series where, between the base panels and side panels, a bevel strip of a known type is provided which can also provide heel engaging formations 96 which are shown in use in FIG. 14. Additionally, the top panel and side panels are hingably interconnected by known shoulder panels which again can comprise article engaging portions, or shoulder engaging portions, such as 97 shown in both FIGS. 13 and 14. In formed carton 100 shown in FIG. 14 it can be seen that base panel portions 91 and 95 are overlapped in a known manner to form a carton base wall which is held together using known locking means 98 provided by each of the base panel portions. Of course, the carton side walls 92 and 94 are longer than in known cartons and indeed the heel and article engaging portions are separated more than usual and indeed associated pairs engage different articles stacked on top of one another rather than the same article as in known cartons.

Figure 15:
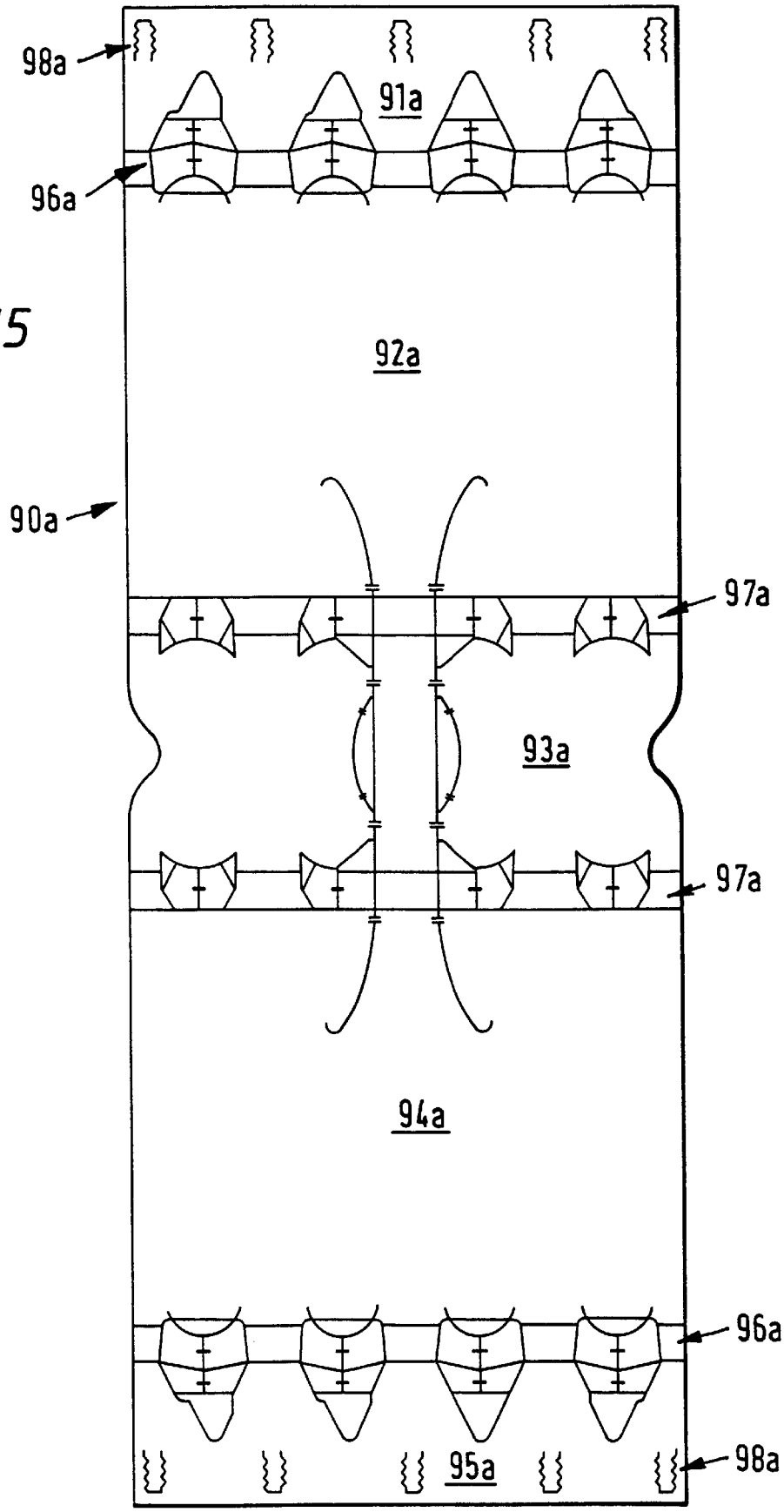
FIG. 15 is a plan view of a second carton blank for a carton according to the invention.

In FIGS. 13 and 14 the carton is adapted to accommodate two tiers of six articles in two rows of three. In a further example shown in FIGS. 15 and 16, a carton 100*a* is adapted to accommodate two tiers of eight articles in two rows of four. In this example, features in common with carton 100 are labelled using the same reference numerals suffixed by the letter a. Of course, each of the cartons can comprise a handle feature which might be one of many forms such as those shown in the drawings.

Whilst the cartons shown here comprise only two tiers or layers of articles, it is possible to provide a carton accommodating three or more layers. Indeed, the number of rows of articles in each tier could also be varied from one upwards.

What is claimed is:

1. A divider panel for separating each one of at least two tiers of stacked articles from one another wherein tops and bottoms of the articles are nestable with one another, the divider panel comprising:

a sheet including at least one substantially continuous annular-shaped member, disposed for operable engagement between the tops and bottoms of the articles.

2. The divider panel of claim 1, wherein said substantially continuous annular-shaped member is defined by an inner aperture and a series of cuts substantially forming an outer circle.

3. The divider panel of claim 2, wherein said series of cuts are discontinuous thereby forming at least one hinge.

4. The divider panel of claim 3, wherein at least one end of at least one of said series of cuts is turned inwardly.

5. The divider panel of claim 1, further comprising at least one recess disposed in an outer edge of said sheet adapted for facilitating alignment of said sheet with respect to an underlying one of the tiers of stacked articles.

6. The divider panel of claim 1, further comprising means for cooperating with articles in an underlying one of the tiers of stacked articles to help maintain the relative position of the sheet therewith.

7. The divider panel of claim 6, said means for cooperating with articles comprising at least one locking tab extensible from said sheet disposed for engagement in a spacing between adjacent ones of articles of the underlying one of the tiers of stacked articles.

8. The divider panel of claim 7, wherein said locking tab is integrally formed with and hingably connected to said sheet.

9. The divider panel of claim 7, further comprising at least one notch disposed in at least one of a longitudinally-oriented anterior end of the sheet in alignment with a locking tab aperture defined by said locking tab.

10. A divider panel for separating each one of at least two tiers of stacked articles from one another, the divider panel comprising:

a sheet including means for cooperating with articles in an underlying one of the tiers of stacked articles to help maintain the relative position of the sheet therewithin;

said means for cooperating with articles comprising at least one locking tab extensible from said sheet disposed for engagement in a spacing between adjacent ones of articles of the underlying one of the tiers of stacked article;

at least one notch disposed in at least one of a longitudinally-oriented anterior end of the sheet in alignment with a locking tab aperture defined by said locking tab.

* * * * *